US008540073B2

(12) United States Patent
Lang

(10) Patent No.: US 8,540,073 B2
(45) Date of Patent: Sep. 24, 2013

(54) BALLOONS

(75) Inventor: Philip Edward Lang, London (GB)

(73) Assignee: Magic International Ltd., London (GB)

( * ) Notice: Subject to any disclaimer, the term of this patent is extended or adjusted under 35 U.S.C. 154(b) by 448 days.

(21) Appl. No.: 12/811,312

(22) PCT Filed: Dec. 23, 2008

(86) PCT No.: PCT/GB2008/004271

§ 371 (c)(1),
(2), (4) Date: Jun. 30, 2010

(87) PCT Pub. No.: WO2009/087352

PCT Pub. Date: Jul. 16, 2009

(65) Prior Publication Data

US 2010/0282625 A1 Nov. 11, 2010

(30) Foreign Application Priority Data

Jan. 7, 2008 (GB) ..... 0800220.6

(51) Int. Cl.
*B65D 65/00* (2006.01)

(52) U.S. Cl.
USPC ..... 206/69; 206/459.5

(58) Field of Classification Search
USPC ..... 206/457, 223, 459.5, 484, 69
See application file for complete search history.

(56) References Cited

U.S. PATENT DOCUMENTS

| | | | | |
|---|---|---|---|---|
| 4,305,501 | A * | 12/1981 | Collette | 206/457 |
| 5,447,010 | A * | 9/1995 | Voigt | 53/427 |
| 5,573,437 | A * | 11/1996 | Van Dyke et al. | 446/75 |
| 5,577,947 | A * | 11/1996 | Malloy et al. | 446/220 |
| 5,755,328 | A * | 5/1998 | DeLuca | 206/522 |
| 6,663,455 | B1 * | 12/2003 | Lang | 446/71 |
| 7,717,347 | B2 * | 5/2010 | Boyd et al. | 235/487 |
| 2002/0178940 | A1 * | 12/2002 | Kitchin et al. | 101/34 |
| 2003/0041750 | A1 * | 3/2003 | Kitchin et al. | 101/34 |
| 2007/0249259 | A1 * | 10/2007 | Pham | 446/224 |

FOREIGN PATENT DOCUMENTS

| | | |
|---|---|---|
| GB | 2429414 A | 2/2007 |
| WO | 00/11067 | 3/2000 |

* cited by examiner

*Primary Examiner* — Jacob K Ackun
(74) *Attorney, Agent, or Firm* — Holland & Hart LLP; Bryan G. Pratt

(57) ABSTRACT

Arrangements are described for enabling a folded foil balloon to be supplied to a printer for enabling an image to be applied to a surface of the balloon. The balloon is first folded around a paper substrate, and a paper cover sheet is attached to the folded-over edge portions and tail portion of the balloon, so as to form a packaged balloon. The packaged balloon is formed with a tapered leading edge to facilitate insertion into a standard ink-jet printer. The packaged balloon may be in the form of a greetings card, with the fold of the card either along the left edge or the top edge of the card. The packaged balloon may be supplied with one or more light sources and/or power sources, either on the inside or outside of the balloon.

17 Claims, 9 Drawing Sheets

BALLOONS

REFERENCE TO PENDING PRIOR PATENT APPLICATION

Figure 1:
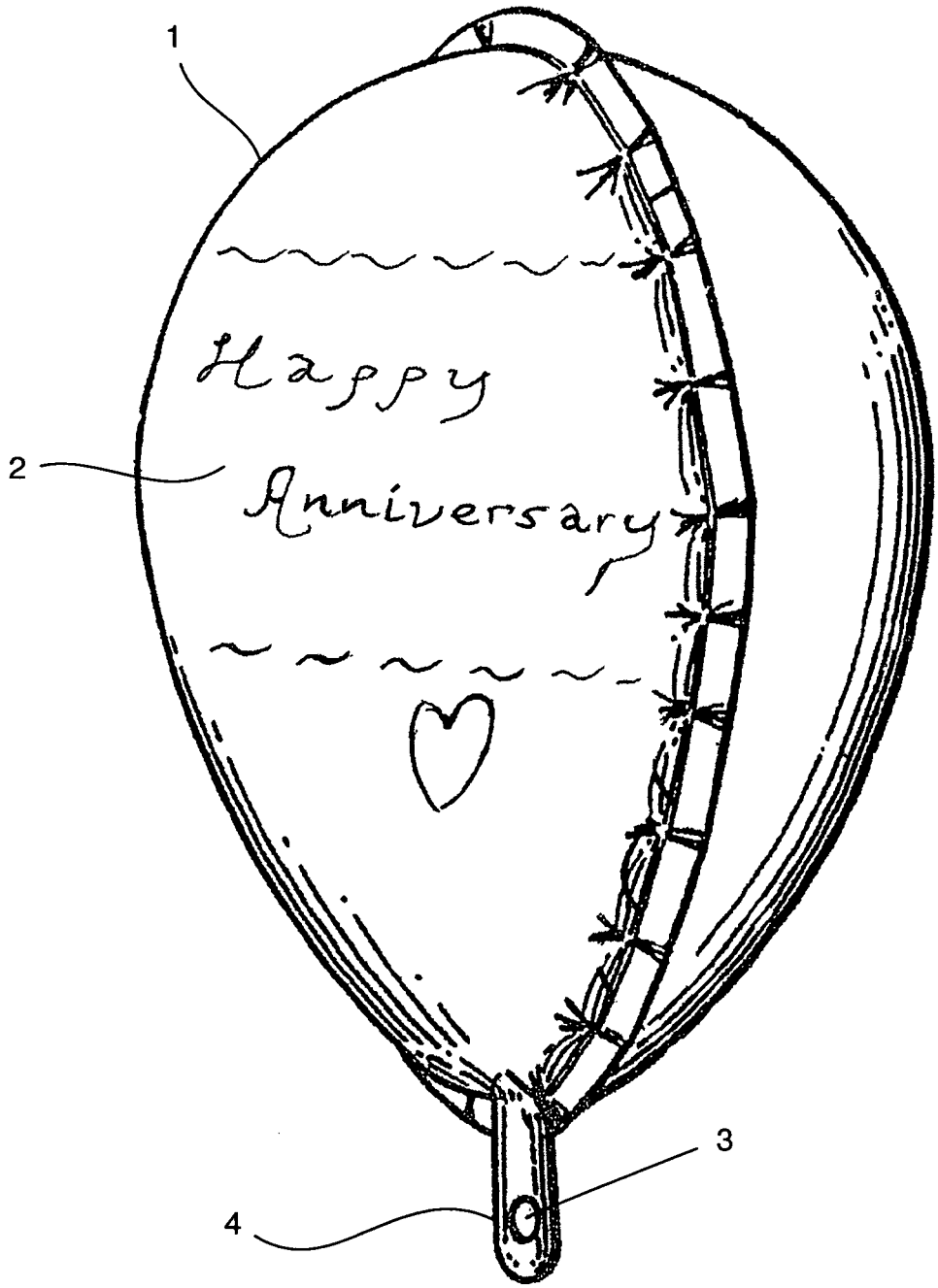
Figure 2A:
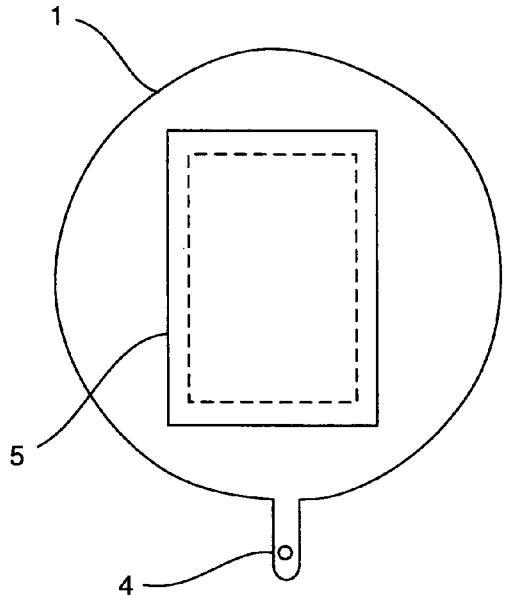
Figure 2B:
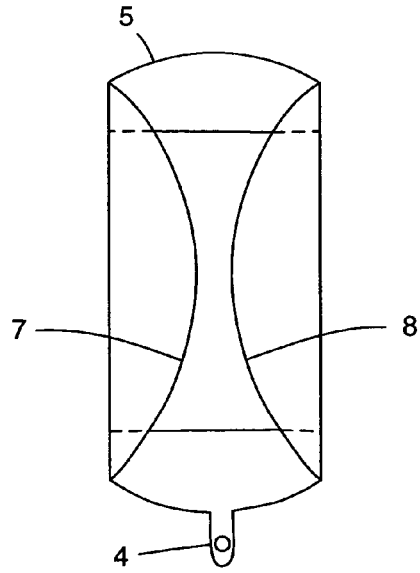
Figure 2C:
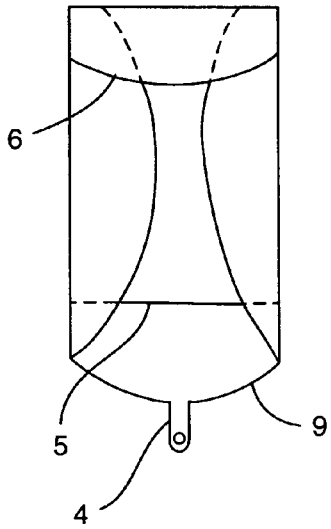
Figure 2D:
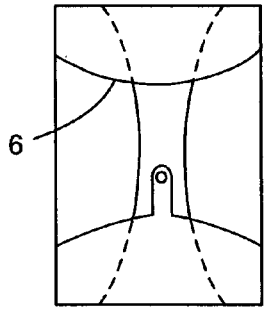
Figure 2E:
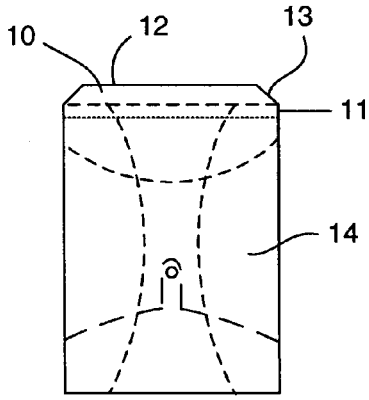
Figure 2F:
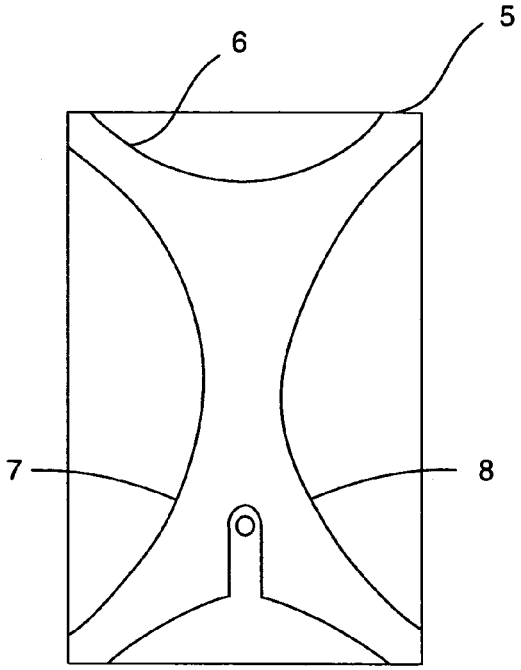
Figure 2G:
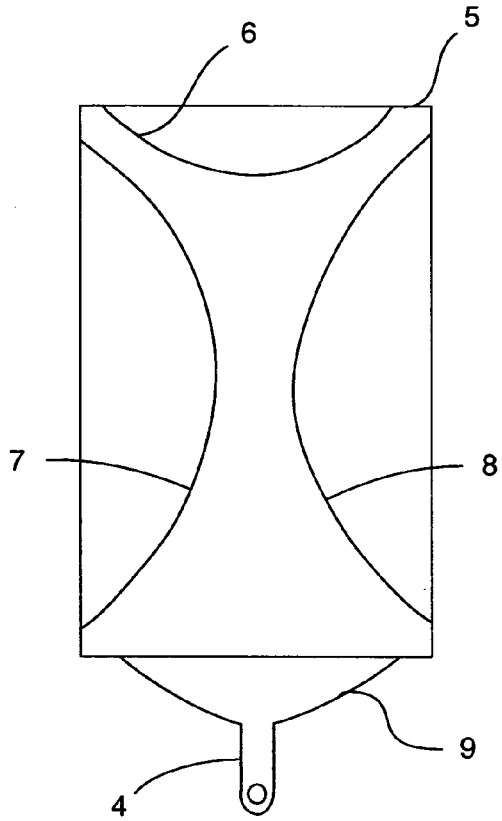
Figure 2H:
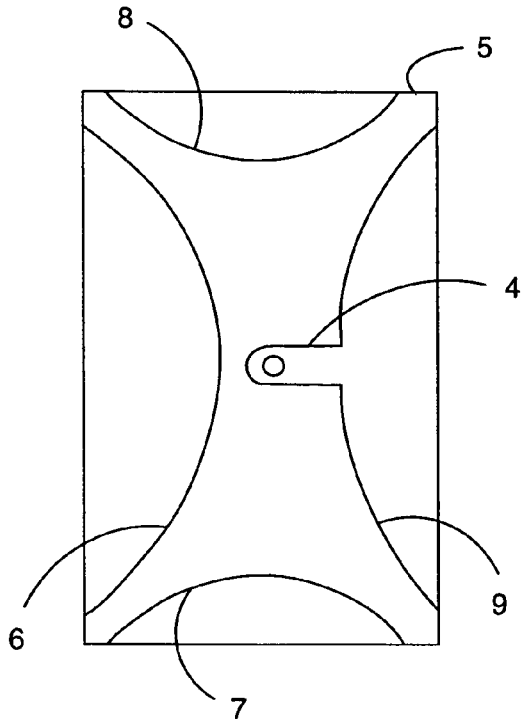
Figure 2I:
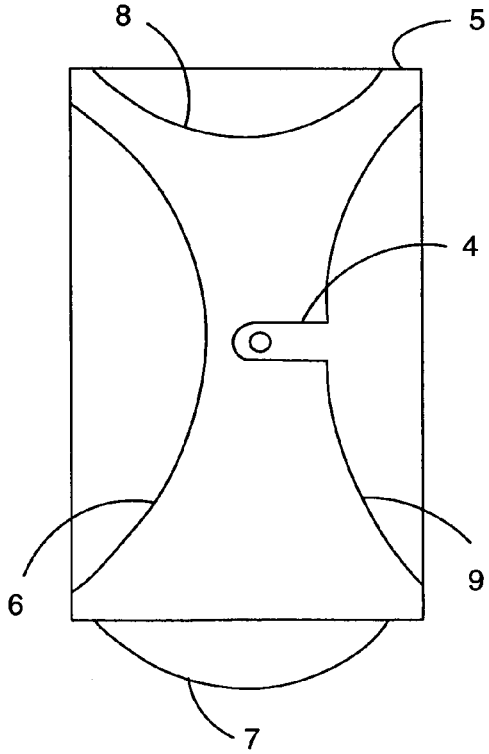

This application is a 35 U.S.C. §371 National Phase Entry Application from PCT/GB2008/004271, filed 23 Dec. 2008, and designating the United States, and claims priority to GB 0800220.6, filed 7 Jan. 2008. Each of the above-identified patent applications are hereby incorporated herein by reference.

The present invention relates to balloons, and in particular to balloons which are packaged to enable an image to be applied to their surface prior to inflation.

Such images may be applied to balloons by standard ink-jet printers, either of the domestic or industrial types, by treating at least a part of the surface of the balloons, e.g. by applying a suitable coating such as an ink-jet lacquer. The treatment of balloons in this way is described in the present Applicant's published European Patent Application No. EP 1115776 A, the full subject-matter of which is incorporated herein by reference. A particular advantage of this technique is that the ink applied cannot easily subsequently be removed from the surface in normal use of the balloon, either prior to, or after, its inflation.

However, it is not normally possible for such balloons to pass through printers without some means of supporting the balloons, since the material of the balloons is typically very thin and therefore not sufficiently rigid to pass through the printer in a reliable and predictable manner.

To overcome this problem, the above-mentioned European patent application describes two different embodiments by which a balloon can be supported as it passes through an ink-jet printer.

In the first embodiment, an uninflated balloon is wrapped around a relatively rigid substrate or former, which can be made of any suitable material such as cardboard. The substrate provides the balloon with the necessary rigidity to enable it to pass through the printer in a reliable manner. In this arrangement, the balloon is wrapped around the substrate in such a way that a part of the surface to which an image is to be applied is arranged on one side of the substrate, and the remainder of the surface of the balloon, which typically includes the rounded edge and tail portions of the balloon, is arranged on the reverse side of the substrate. After the balloon has passed through the printer and a design has been printed on its surface, the balloon can be unwrapped from the substrate and inflated. The substrate can then be re-used or discarded.

In the second embodiment, the balloon is folded into a convenient rectangular shape and inserted into a packet which is provided with an aperture on one side. In this arrangement the external packet provides the necessary support to enable the balloon to pass through the printer, and an image is printed on to the region of the surface of the balloon which is exposed through the aperture of the packet.

Each of these two embodiments has proved to be of great commercial success.

The present invention seeks to provide improvements to these embodiments.

In particular, it would be desirable to improve the first embodiment in such a way that those parts of the surface of the balloon to which an image is not applied, which typically include the rounded edges and tail of the uninflated balloon, are not exposed during passage of the balloon through a printer.

It would also be desirable to improve the second embodiment in such a way that an image can be applied to the surface of the balloon across the entire width of the packet, as opposed to just that portion of the surface of the balloon which is exposed through the aperture in the packet. Furthermore, the provision of an aperture can in some circumstances lead to buckling of the packet in the region bordering the aperture, especially when the package is caused to bend, which can occur when passing through certain types of printers.

It will be appreciated that, for an image to be applied to a folded balloon using a standard ink-jet printer, the thickness of the folded balloon must be thin enough to allow it to pass through such a printer. Clearly, any additional component which adds to the thickness of the folded balloon would normally be considered undesirable.

However, the inventor of the present invention has found surprisingly that it is possible to add a component to the folded balloon which has only a marginal effect on the overall thickness of the folded balloon but which provides a number of advantages.

Thus, in accordance with a first aspect of the present invention there is provided a packaged balloon on which an image is to be applied, the packaged balloon comprising: (a) a balloon which is folded so as to present a first face on which the image is to be applied, and a second face containing at least one edge of the balloon; and (b) a planar member attached to the second face of the folded balloon so as to cover the at least one edge of the balloon.

The planar member therefore acts as a backing sheet for the folded balloon.

This arrangement provides at least the following technical advantages compared with the above-described prior art.

Since at least one of the edges of the balloon is covered by the planar member, this prevents these edges from becoming unfolded from the remainder of the balloon while the image is being applied to the balloon. Thus, in the case where an image is applied to the folded balloon by means of a printer which involves causing the packaged balloon to move along a pathway through the printer, the provision of the planar member prevents otherwise-exposed areas of the folded balloon, including the tail and the edges, from becoming detached from the remainder of the balloon and thereby possibly trapped in the printer, such as by the action of printer driver wheels.

The planar member also provides a barrier between the folded edges and tail portion of the balloon and the internal surfaces of the printer, thereby preventing damage to both the balloon itself and to the printer. However, in one embodiment which is arranged for an image to be applied to the balloon in portrait format, the tail portion of the balloon is not folded over the substrate and forms a trailing portion of the packaged balloon as is passes through an image-applying apparatus. Alternatively, when the image is to be applied to the balloon in landscape format, one of the two side portions of the balloon forms a trailing portion of the packaged balloon instead of the tail portion.

Furthermore, the planar member causes the packaged balloon to be essentially flat, which results in the distance between the first surface of the folded balloon and the printhead being substantially constant throughout the passage of the folded balloon through the printer, and this reduces the likelihood of streaking which can occur when printing an image on to uneven surfaces.

In addition, the provision of a planar member removes the need for additional support in the form of an external packet and therefore enables an image to be applied to the entire first face of the folded balloon.

Furthermore, such packaged balloons can readily be stacked on a printer input feed tray and are also less likely to become snagged on any portions of the feed tray which are not flat.

The planar member can also serve as a medium on which instructions and other relevant information can be printed for the benefit of the user, thereby removing the need for the supplier to provide additional packaging containing such information. In addition, the presence of a planar member, with or without any printed information thereon, enhances the aesthetic appearance of the packaged balloon.

It is advantageous to apply an adhesive to the surfaces of the balloon so as to retain the balloon in its folded state while the image is applied. In this case, the planar member acts as a barrier to such adhesive and thereby prevents the adhesive from coming into contact with the components, e.g. rollers, of a printer used to apply the image to the first face of the folded balloon.

The planar member preferably covers entire second face of the folded balloon, which gives rise to a packaged balloon having two continuous surfaces, which facilitates its passage through any machine which may be used to apply an image thereto, since it is easier for those components of which are used to grip the packaged balloon to do so when both surfaces are continuous. The gripping of the packaged balloon is particularly enhanced by the provision of the planar member when the surface of the balloon itself is made from a low-friction material, and for this reason, the outward-facing surface of the planar member is advantageously roughened, or made with a high-friction material so as both to facilitate and strengthen its engagement with the "grabbers" used in printers, such as those manufactured by the Hewlett-Packard Company in the Photosmart® range.

In a preferred embodiment, the balloon is made from a foil material, and at least a part of the first face of the folded balloon has been treated to permit an image to be applied by ink-jet printing.

Ink-jet printing is advantageous in that it operates at substantially ambient temperatures, as compared with some other current types of printers such as laser printers and dye sublimation printers. Dye sublimation printers are based on a simple yet effective process of professionally and permanently applying a photo-quality image on to a large range of items, to create high-quality saleable products. However, the types of foil currently available for manufacturing balloons cannot normally withstand the temperatures typically encountered in laser and dye sublimation printers.

However, the concepts of the present invention are sufficiently broad as to encompass the use of means for applying designs other than ink-jet printers, including apparatuses which are not currently available, and also to encompass the application of images to balloons made from materials which are not currently available. Thus, for example, although currently available foils which are suitable for manufacturing balloons cannot normally withstand the temperatures encountered in current laser or other printers, it is of course possible that future materials may be able to withstand such high temperatures, and, conversely, it is possible that future laser, or other, printers may operate at lower temperatures.

The planar member may be made from any suitable material, such as paper, card, polyester or plastic. Ideally, the planar member should be thinner than the folded balloon, so that the leading edge of the packaged balloon can be readily accepted into a printer, such as an ink-jet printer.

The packaged balloon preferably comprises a substrate around which the balloon is folded. This not only provides an additional means of supporting the folded balloon in its passage through a printer but also acts as a surface to which the folded balloon can be attached by a suitable adhesive. The substrate is therefore preferably of sufficient rigidity to provide a suitable degree of support to the folded balloon.

As with the planar member, the substrate can be made from any suitable material, such as paper, card, polyester or plastic.

The planar member is preferably attached to the folded balloon by means of at least one line of adhesive across the width of the leading edge of the packaged balloon, so that the trailing portions of the folded balloon and planar member are able to move longitudinally relative to each other when moving along a curved path through a printer. In the preferred embodiment, a single line of adhesive is used. It will be appreciated that, without this feature, there would be a tendency for the inner surfaces of the packaged balloon to buckle when moving along such a curved path. A suitable adhesive is of the type used in the Post-it® range of products manufactured by the 3M Company or a suitable repositioning adhesive, such as those distributed by Anglo Adhesives & Services of The Airfield, Dalby Road, Melton Mowbray, LE13 0BL, United Kingdom and Ghiant nv./sa., Industrieweg 7, 2340 Beerse, Belgium, or the adhesives used for the glue guns supplied by Nordson (UK) Ltd., of Thame Industrial Estate, Wenman Road, Thame, OX9 3SW or adhesives manufactured by Sealock Adhesives Ltd., of Scott Close, Walworth Industrial Estate Andover, SP10 5NU, United Kingdom, of which the preferred adhesive is Glue No. E13483/1B, which is a high-polymer emulsion with low fire risk and low toxicity.

In one embodiment, the planar member is sized to cover substantially exactly the second surface of the folded balloon. However, in a preferred embodiment, the planar member occupies a slightly larger area than that of the folded balloon so as to form one or more leading edges which assist a user in the insertion of the packaged balloon into a printing machine. This is of particular utility when the image is to be applied using printers which more readily accept relatively thin sheets of printing medium, such as ink-jet printers manufactured by Brother, Epson and Lexmark.

The preferred shape of the packaged balloon is substantially square or rectangular, and the planar member preferably extends beyond the area occupied by the folded balloon on at least two sides, so as to define at least two possible leading edges to facilitate the insertion of the packaged balloon into an ink-jet printer in at least two different orientations of the packaged balloon.

The two leading edges can be adjacent or opposite.

Furthermore, it is preferred that the sides of the or each leading edge are shaped so as to further facilitate the insertion of the packaged balloon into an ink-jet printer. To achieve this aim, it is preferred that the sides of the edges are tapered, i.e. cut at an angle, such that the leading edge has a width which is slightly less than that of the folded balloon.

When the packaged balloon is generally elongate, for example rectangular or oval-shaped, one option is that the balloon is folded such that, when the balloon is inflated, the image appears in landscape format.

Alternatively, the balloon is folded such that, when the balloon is inflated, the image appears in portrait format.

The unfolded balloon can be of any desired shape, such as circular or heart-shaped.

The packaged balloon may be of any size which can be accepted by printers. However, it is preferred that the packaged balloon is of a size substantially equal to A3 for the retail market, and substantially equal to A4 for home use. By "A3" and "A4" are meant the sizes defined by International Standard ISO 216, i.e. 420 mm long and 297 mm wide, in the case of A3, and A4=297 mm long and 210 mm wide, in the case of A4.

However, the especially preferred size for the packaged balloon is "super A3", sometimes referred to as "A3+", which is 19 inches (482.6 mm) by 13 inches (330.2 mm) wide, which defines an area approximately 30% greater than standard A3 size.

Images which are substantially larger than A3 or super A3 can be applied to correspondingly large balloons using commercially available printers, and such balloons are ideal as advertising dirigibles or blimps.

In an alternative embodiment, the planar member may be formed integrally with, or joined to, a further planar member extending across an edge of the first surface of the folded balloon, thereby to provide a single leading edge to facilitate insertion of the packaged balloon into an image-applying apparatus. In this case, it is preferred that both the planar member and the further planar member extend beyond the area occupied by the folded balloon so as to define a leading edge to facilitate the insertion of the packaged balloon into a printer. Again, the sides of the leading edge are advantageously tapered. The further planar member and the folded balloon are preferably attached together by means of a single line of adhesive.

In a further alternative embodiment, the packaged balloon additionally comprises a cover which extends over at least part of the planar member and which is folded over one of the edges of the planar member and is attached to an edge of the first surface of the folded balloon, so as to define a leading edge to facilitate the insertion of the packaged balloon into a printer.

In any of the above arrangements, a protective or decorative cover is preferably supplied which extends over the first surface of the folded balloon and which can be removed from the folded balloon prior to an image being applied thereto. The cover can be transparent.

A particularly beneficial embodiment of the present invention is in the form of a greetings card, for sending on special occasions, such as birthdays, anniversaries, weddings and civil partnership ceremonies. In this case, the planar member itself comprises, or forms a part of, a greetings card.

The greetings card can be in the form of a card which is folded along either the left edge, in the conventional manner, or alternatively along the top edge.

When the planar member forms part of a greetings card, it is preferably detachable from the remainder of the card. In this case, the planar member is provided with a perforated edge, or alternatively a repositionable adhesive such as Scotch-Weld® manufactured by the 3M Company, to facilitate its detachment.

In such a greetings card, the folded balloon may be attached to the rear surface of the card, with the first face of the folded balloon facing outwards, and the packaged balloon preferably further includes a protective removable cover sheet overlying the folded balloon. Alternatively, the folded balloon may be attached to an inner surface of the card, with the first face of the folded balloon facing inwards.

In an alternative embodiment, the packaged balloon comprises a planar member which is provided with an adhesive layer on its outer surface to which is attached an outer protective covering sheet. Such a packaged balloon can readily be attached to a greetings card simply by removing the protective covering sheet from the planar member to expose the underlying adhesive layer which is used to attach the packaged balloon to the greetings card.

The balloon may be formed with an image already on its surface which supplements the image applied. In this case, the image already formed on the balloon is within a region of the surface distinct from the region where the image is to be applied.

The image already formed on the balloon is preferably at least partially within a region which borders the region where the image is to be applied so as to allow the already-formed image and the image printed by the ink-jet printer to be continuous.

Plastic foil balloons are usually manufactured from metallic foil which is believed to act as a barrier to prevent helium from escaping. However, many balloons are inflated by the user blowing air into the inflation aperture, and, in this case, there is no need for the metallic foil to be present. The inventor of the present invention has discovered that such balloons are translucent, which provides the opportunity for some desirable special effects. For example, such balloons can be illuminated internally, either by one or more light sources suspended within the balloon from the neck, and/or for one of more light sources attached directly to the inner surface of the balloon. In conjunction with balloons to which designs have been applied using the ideas presented above, such illumination is particularly aesthetically desirable.

Thus, in one embodiment of the present invention, at least a part of the balloon within the packaged balloon comprises plastic foil which is translucent, and may further comprise at least one light source inside the balloon, the light source(s) being either attached to the inner surface of the balloon and/or connected to the neck of the balloon by a support such that, when inflated, the light source is spaced from the inner surface of the balloon. Alternatively, one or more light sources could be connected to the outer surface of the translucent balloon.

The packaged balloon may comprise a holding leash or ribbon conductor which connects a source of power, such as a battery, to the light source(s). When inflated with helium, the battery could then act as a weight which applies tension to the balloon leash. Alternatively, a power source in the form of one or more batteries may be located within the balloon.

A particularly desirable embodiment of the present invention derives from the fact that a number of planar members could be formed integrally in a continuous band. This means that a large number of packaged balloons could be conveniently connected together by means of detachable connections between adjacent planar members within the continuous band. In this case, the detachable connections are conveniently formed by perforated edges of the planar members.

For ease of manufacture, it is preferred in this case that the folded balloons are attached to the same side of the connected planar members.

The resulting connected arrangement of packaged balloons could be packaged as a fan-fold stack, or alternatively in the form of a reel on a former.

The present invention extends to a method of packaging a balloon to enable an image to be applied to the surface of the balloon, the method comprising: folding the balloon so that the folded balloon presents a first face on which the image is to be printed, and a second face containing at least one edge of the balloon; and attaching a planar member to the second face of the folded balloon so as to cover the at least one edge of the balloon.

The balloon may advantageously be made from plastic foil, or indeed any suitable material.

The planar member preferably comprises a layer of adhesive which enables it to be so attached to the folded balloon.

The method advantageously further comprises applying adhesive to the second face of the folded balloon, thereby enabling the planar member to be attached thereto.

The step of applying adhesive to the second face of the folded balloon comprises preferably applying a row of spots of adhesive along at least one of the edges of the second face of the folded balloon, e.g. by rolling. However, it is preferred that the adhesive is applied along only the leading edge of the folded balloon, in order to provide some freedom of relative longitudinal movement between the balloon and the substrate as it passes through a curved path in an image-applying apparatus, such as a printer.

The resulting packaged balloon may subsequently be supplied to a nip between two rollers for flattening the outer surfaces thereof.

Some balloons have been found to contain a small amount of air after manufacture, and this could lead to the balloons bursting when subjected to the above rolling process. To overcome this, it has been found desirable to cut one or more grooves in one or both rollers in order to allow the air to escape.

An alternative way of avoiding the problem is for most, but not all, of the surface of the packaged balloon to be subjected to the rolling process. This can be achieved by supplying the packaged balloon to the rollers and then reversing the direction of rotation of the rollers before the packaged balloon has completely passed through the nip.

However, it has been found that, even when the packaged balloon has been flattened in this way, the folded edges can, over time, become rounded. It is believed that that results from the nylon material of the balloon which has a "memory" of its original shape, such that the flattening of the balloon causes by the rolling process is merely temporary. To overcome this problem, it is preferred that the packaged balloon is sealed under vacuum in an outer case immediately after the rolling process. The effect of the outer case is to compress the folds of the packaged balloon such that, when removed from the case, the packaged balloon is completely flat and remains so for a time sufficient to enable a user to print an image on the surface before the folds of the packaged balloon can become rounded. The packaged balloon is thus removed from the sealed case by the user immediately before inserting the packaged balloon into a printer. The case may be made from polyethylene or any other suitable material which can effectively maintain the vacuum.

The present invention therefore extends to a packaged balloon of the above type, provided within a vacuum-sealed container.

The method preferably further comprises applying an image to the surface of the balloon using a printing process. In the case of ink-jet printing, at least a part of the first face of the folded balloon is pre-treated to permit the image so to be applied.

In view of the adverse effects on the environment of many of today's commercial plastics products, it would be desirable that the materials chosen for the balloons are environmentally friendly. It is therefore preferred that the material of the foil be made from a biodegradable substance. In a preferred embodiment of the present invention, the balloon comprises a material containing at least some plastics material made from potato starch. Such plastics materials are commercially available, e.g. from Sphere S.A. of 3, rue Scheffer, Paris, France.

Thus the present invention extends to a balloon which is made from a biodegradable material.

The present invention further extends to a balloon which is made from a plastics material comprising potato starch.

Figure 3A:
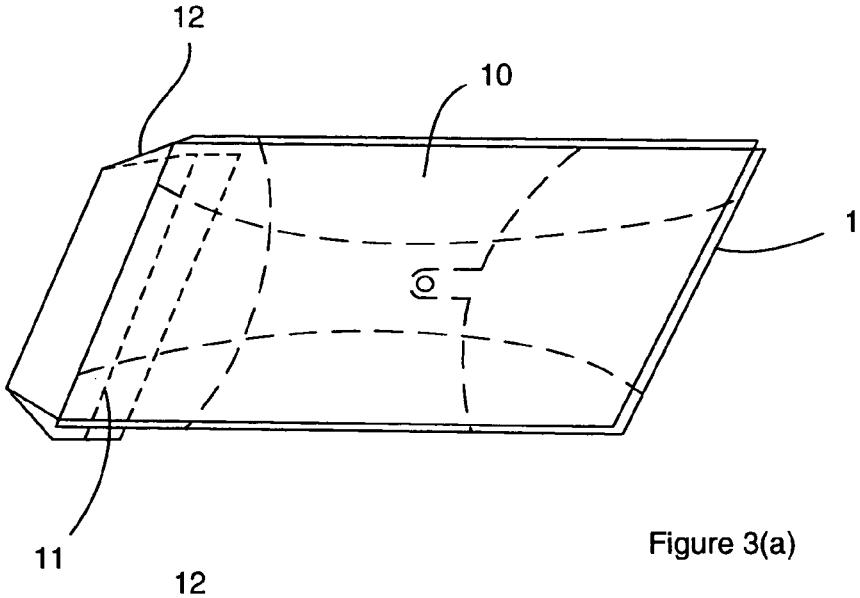
Figure 3B:
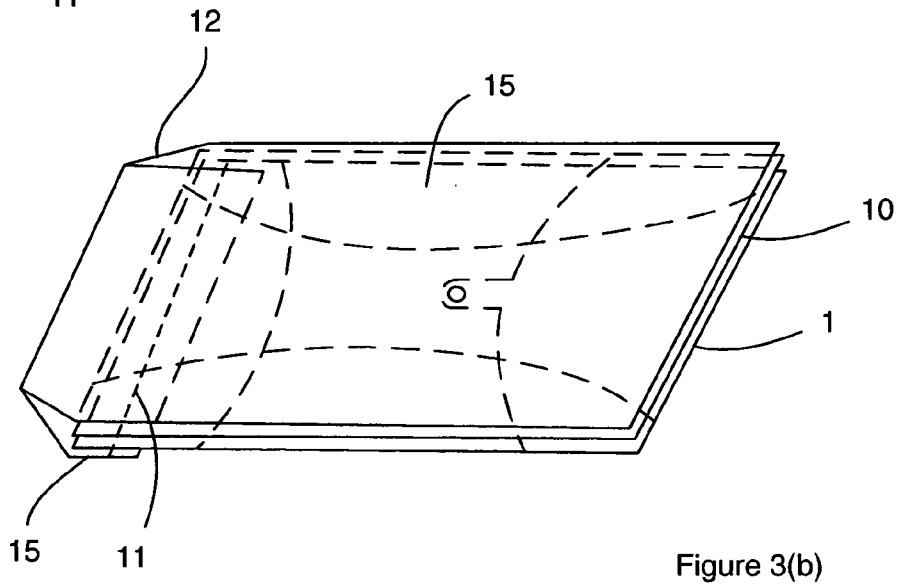
Figure 3C:
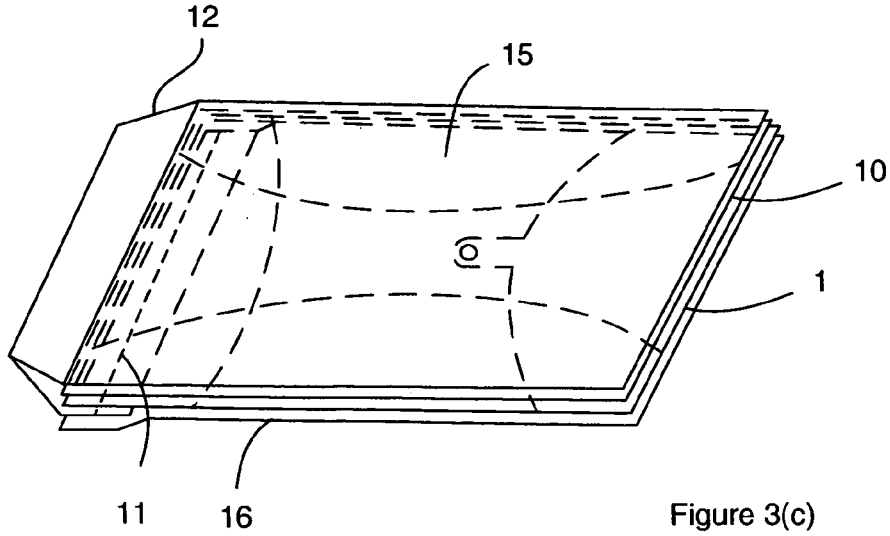
Figure 4:
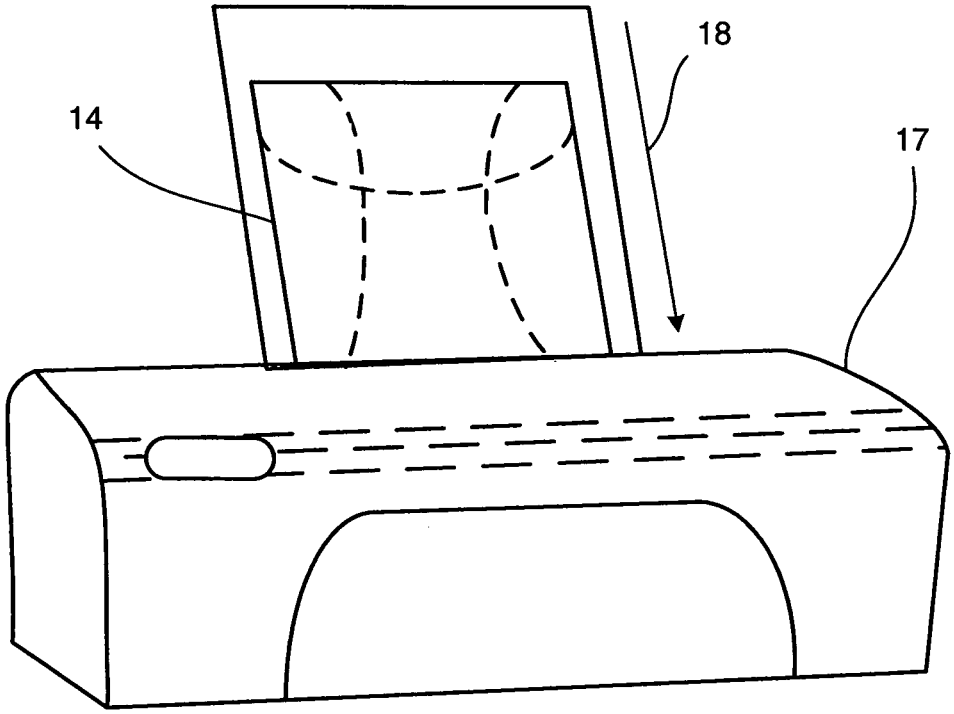
Figure 5A:
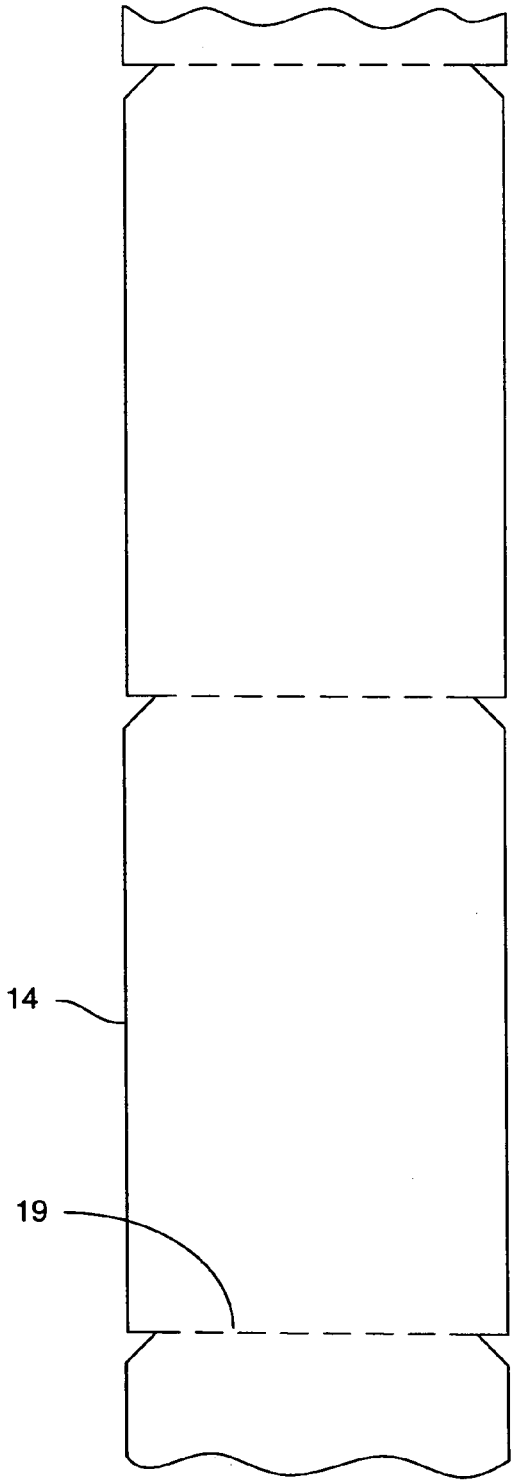
Figure 5B:
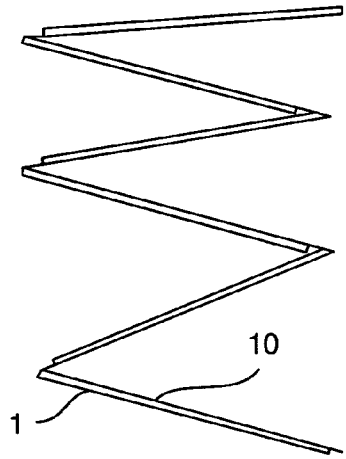
Figure 5C:
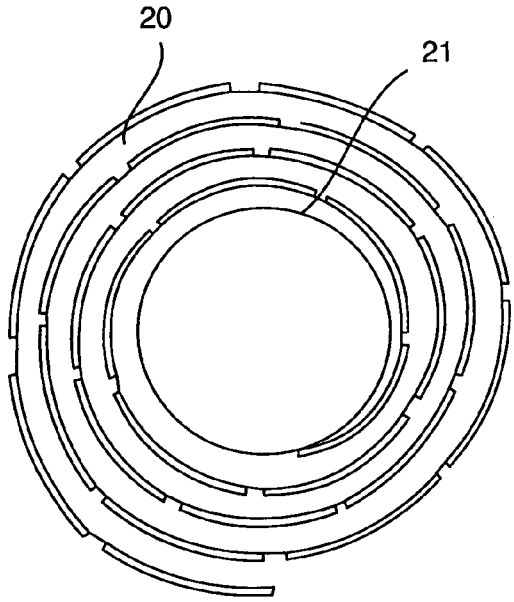
Figure 6A:
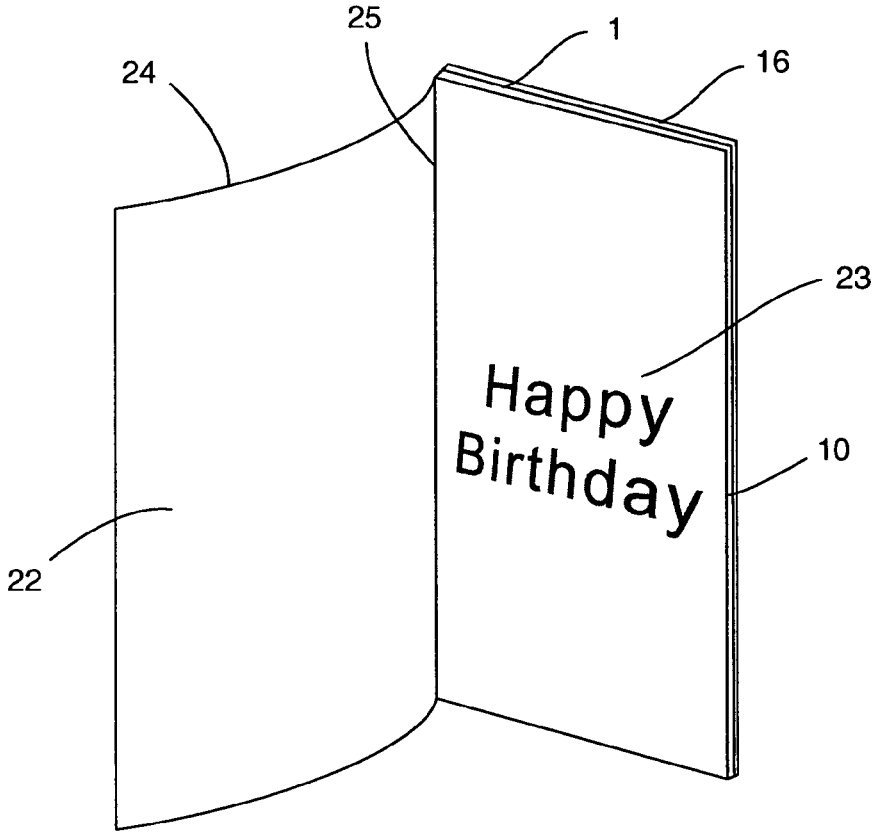
Figure 6B:
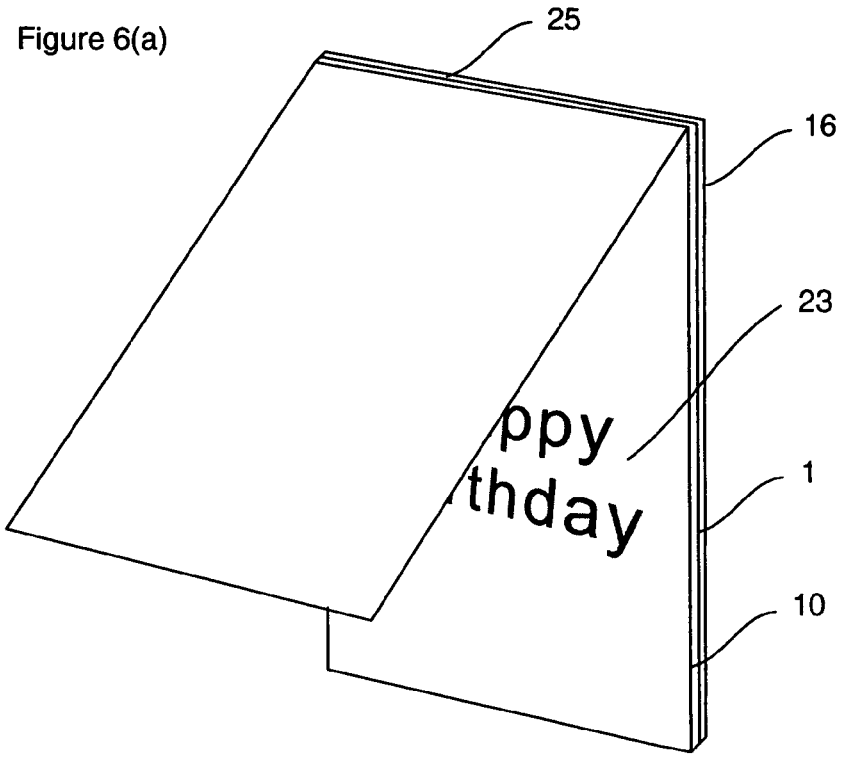
Figure 7:
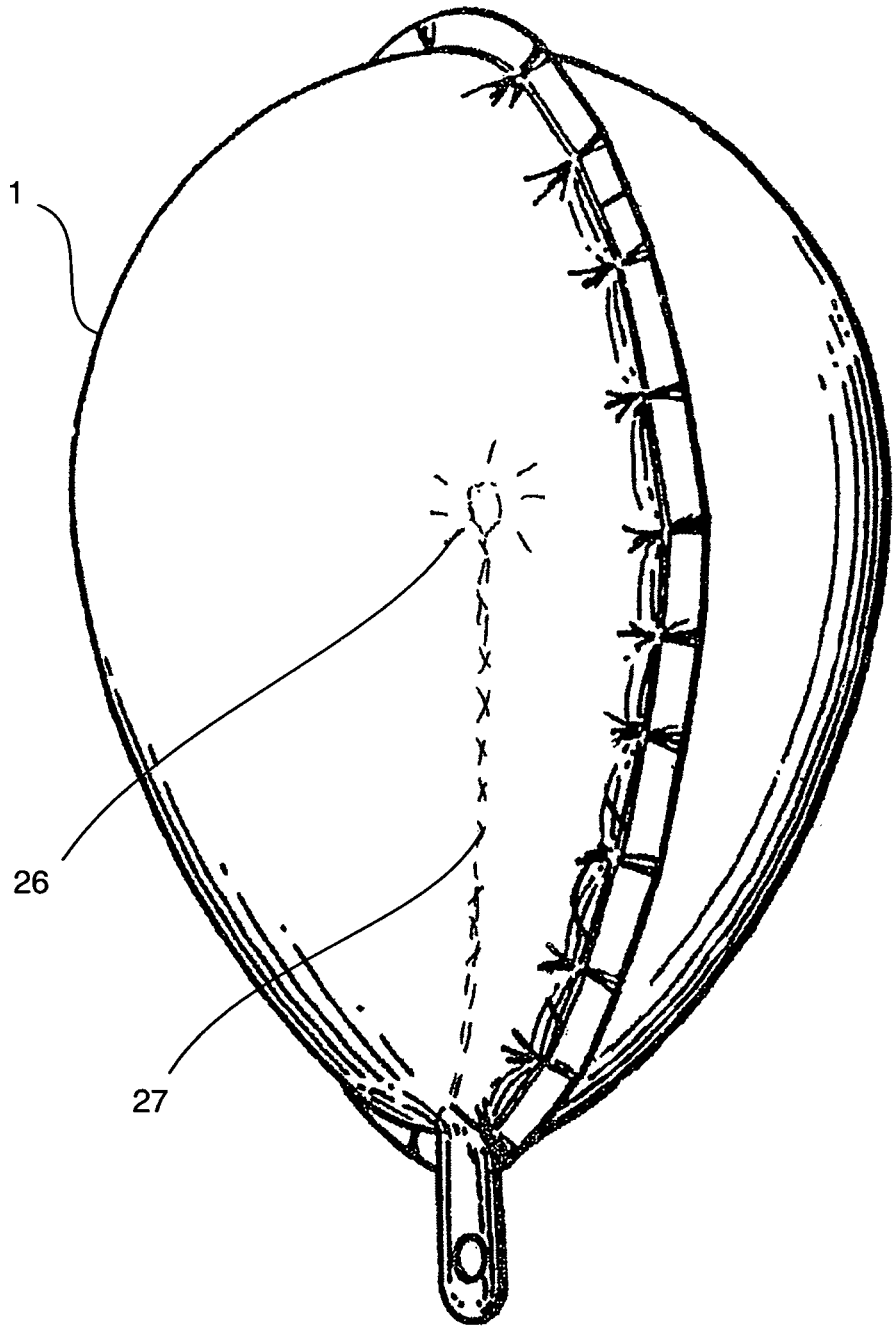
Figure 8:
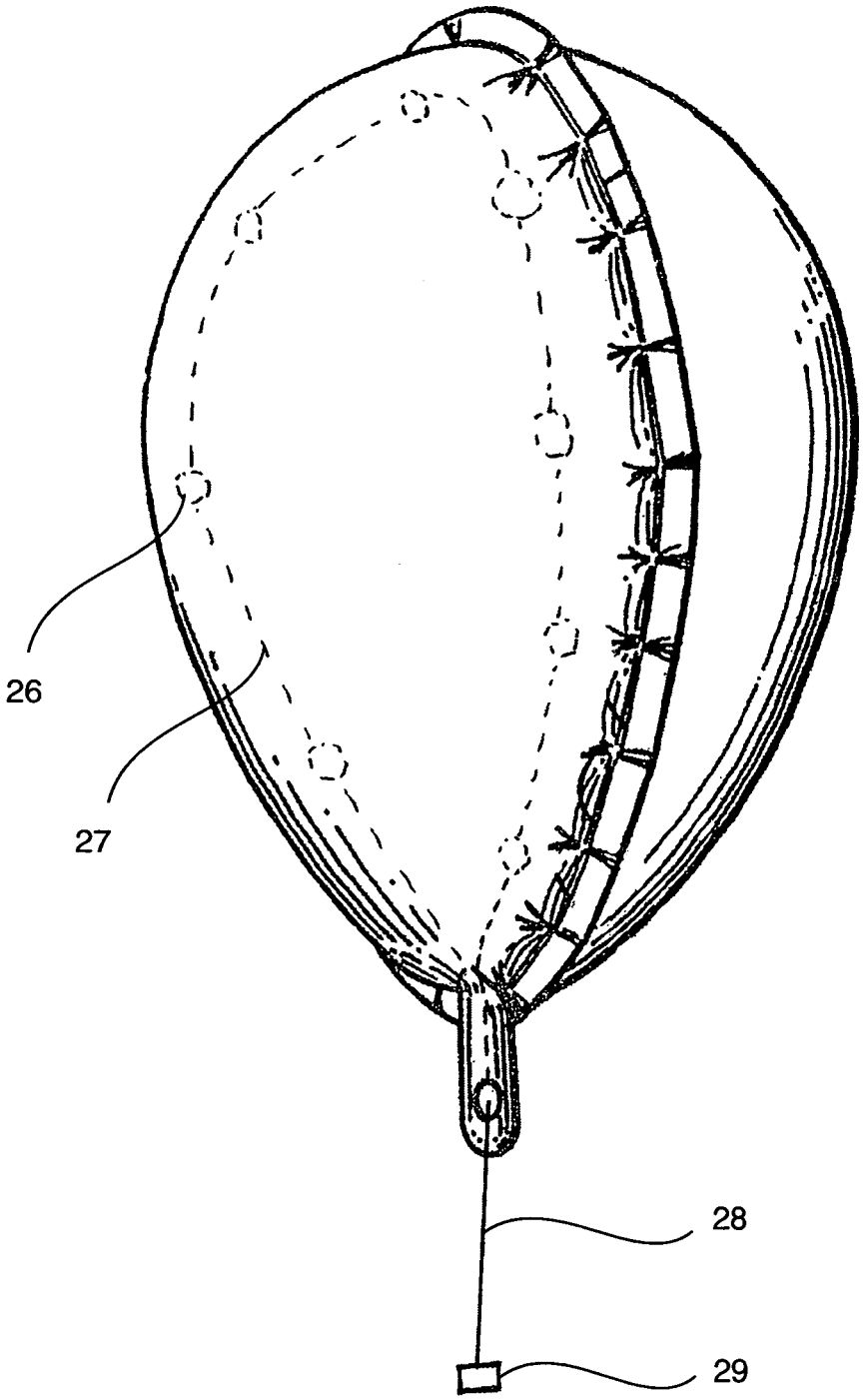

Preferred embodiments of the present invention will now be described with reference to the accompanying drawings, in which:

FIG. 1 illustrates an inflated foil balloon to which a design has been applied;

FIGS. 2(*a*) to 2(*e*) illustrate the stages in forming a packaged balloon in accordance with a preferred embodiment of the present invention;

FIGS. 2(*f*) to 2(*i*) illustrate alternative embodiments to that illustrated in FIGS. 2(*a*) to 2(*e*);

FIGS. 3(*a*) to 3(*c*) illustrate three alternative embodiments of the present invention;

FIG. 4 illustrates the insertion of a packaged balloon in accordance with a preferred embodiment of the present invention into an ink-jet printer;

FIGS. 5(*a*) to 5(*c*) illustrate embodiments of the present invention in which packaged balloons are connected together;

FIGS. 6(*a*) and 6(*b*) illustrate two alternative embodiments of the present invention in which the packaged balloon forms a part of a greetings card; and FIGS. 7 and 8 illustrate two alternative embodiments of the present invention in which one or more light sources are arranged within an inflated balloon.

FIG. 1 illustrates an inflated foil balloon 1 bearing a "Happy Anniversary" greeting 2 which has been printed on to the surface of the balloon 1 by a standard ink-jet printer prior to inflation by folding the balloon 1 and attaching a sheet thereto which covers the edges of the folded balloon 1 so as to form a packaged balloon, and the then inserting the packaged balloon into the ink-jet printer. The balloon 1 is inflated by attaching a source of helium gas or other suitable gas to an inflation aperture 3 in the tail portion 4 of the balloon 1.

FIGS. 2(*a*) to 2(*e*) show the process for packaging the balloon in accordance with a preferred embodiment of the present invention. A substrate 5 in the form of a sheet of A4 (or alternatively A3) paper is laid in the centre of an unfolded balloon 1 prior to inflation, as shown in FIG. 2(*a*). The side edge portions 7, 8 of the balloon 1 are then folded over the substrate 5 and attached to the substrate 5 by means of a light adhesive which is sufficient to retain the side edge portions 7, 8 of the balloon 1 in position on the substrate 5 as it passes through an ink-jet printer. The adhesive is applied to the substrate in the form of lines of 5 mil (0.13 mm) width along each of the four edges, as indicated by dotted lines in FIG. 2(*a*). The resulting arrangement is shown in FIG. 2(*b*). The top edge portion 6 of the balloon 1 is then folded over the substrate 5 and over a part of each of the two side edge portions 7, 8 and attached to both the substrate 5 and these side edge portions 7, 8, using the same adhesive, as shown in FIG. 2(*c*). In a similar fashion, the bottom edge portion 9 of the balloon 1, which includes the tail portion 4, is then folded over the substrate 5 and over a part of each of the two side edge portions 7, 8 and attached to both the substrate 5 and the two side edge portions 7, 8, as shown in FIG. 2(*d*). Finally, a planar member in the form of a paper cover sheet 10 is attached to the folded balloon, again using a light adhesive, so as to cover all of the four edge portions 6, 7, 8, 9 of the balloon 1, as shown in FIG. 2(*e*). The adhesive is applied along a line 11 of 5 mil (0.13 mm) width, as indicated in FIG. 2(*e*) by a dotted line, along the top edge of the packaged balloon 1 in the orientation shown in FIG. 2(*e*). The width of the paper cover sheet 10 is equal to that of A4 size, but is slightly longer, by about 2 to 3 mil (0.05 to 0.08 mm), so as to form a leading edge 12. This leading edge 12 is formed with tapered sides 13 to facilitate insertion of the resulting packaged balloon 14 into a printer.

The packaged balloon 14 has two outer surfaces which are continuous and which can therefore readily pass through standard commercially available printers so as to enable an image to be printed in the central A4 (or alternatively A3) region of the outer surface of the folded balloon 1, which is the region of the balloon beneath the substrate 5 in the orientation of FIGS. 2(*a*) to 2(*e*) and referred to below as the "first surface" of the folded balloon 1. The reverse outer surface of the folded balloon 1 is referred to below as the "second surface" of the folded balloon 1.

In an alternative arrangement, the step illustrated in FIG. 2(*d*) is omitted, such that the bottom edge portion 9 of the balloon 1, including the tail portion 4, is not folded over the substrate 5, and forms a trailing edge of the packaged balloon as it passes through an ink-jet printer. In this case, it is not necessary to apply a line of adhesive on the substrate along its trailing edge (i.e. the lower edge as shown in FIG. 2(*a*)).

In the arrangement illustrated in FIGS. 2(*a*) to 2(*e*), the resulting image is oriented vertically, i.e. in a portrait format. However, by attaching the balloon 1 to the substrate 5 with the substrate 5 arranged at right angles to the relative orientation shown in these drawings, it is of course possible to arrange for the resulting image to be oriented horizontally, i.e. in a landscape format.

FIGS. 2(*a*) to (*e*) illustrate an embodiment in which four portions of the balloon (i.e. the corner portions as viewed in FIG. 2(*b*)) are folded twice, which is the preferred arrangement when the size of the packaged balloon is A4. However, when the size is selected to be A3 or super A3, it has been found that the size of the balloon is such that only a single fold may be required, as is illustrated in FIG. 2(*f*), in the case of images to be printed in portrait format, and in FIG. 2(*h*) when images are to be printed in landscape format. In this situation, the tail portion 4 of the balloon (in the case of FIG. 2(*f*)) or one of the two side portions (in the case of FIG. 2(*h*)) need not be folded at all, as illustrated in FIGS. 2(*g*) and 2(*i*) respectively, and can form a trailing part of the packaged balloon as it passes through the ink-jet printer. Again, in n this case, it is not necessary to apply a line of adhesive on the substrate along its trailing edge (i.e. the lower edge as shown in FIG. 2(*a*)).

A first alternative embodiment is illustrated in FIG. 3(*a*), in which the length of the paper cover sheet 10 is greater than A4 size by about 3 cm and folded back on itself and attached to the leading edge of the first surface of the folded balloon 1. In this case, the cover sheet 10 is attached to both sides of the folded balloon using two respective narrow strips 11 of adhesive, again indicated by a dotted line in as with the embodiment shown in FIG. 2(*e*). As with the embodiment of FIG. 2(*e*), a tapered leading edge 12 is provided, but in this case it is formed by the folded front portion of the cover sheet 10. With this embodiment, the printer will encounter only a single leading edge 12 as the packaged balloon passes therethrough, since the leading edge of the folded balloon 1 is completely (or at least partially) covered by the folded cover sheet 10.

A second alternative embodiment is illustrated in FIG. 3(*b*), in which the paper cover sheet 10 is of A4 size and an outer sheet 15, which is the same size as the cover sheet 10 of the embodiment shown in FIG. 3(*a*), is attached to the leading edges of both the first surface of the folded balloon and the cover sheet 10. In this arrangement, three narrow strips 11 of adhesive are applied, as indicated by the dotted line in the drawing: (a) between the folded-over portion of the outer sheet 15 and the first surface of the folded balloon 1, (b) between the second surface of the folded balloon 1 and the cover sheet 10; and (c) between the cover sheet 10 and the outer sheet 15.

A third alternative embodiment is illustrated in FIG. 3(*c*), which is identical to that of FIG. 3(*b*), except for the provision of an additional transparent sheet 16 which overlies the first surface of the folded balloon 1 and serves to protect it. Prior to insertion in a printer, this transparent sheet 16 is removed so as to expose the underlying first surface of the folded balloon 1.

A fourth alternative embodiment is identical to the third alternative embodiment, except that the additional sheet is opaque.

FIG. 4 illustrates the insertion of a packaged balloon 14 of the above-described type into a standard domestic ink-jet printer 17 in the direction indicated by the arrow 18. Although the ink-jet printer illustrated in FIG. 4 is of the "top-loading" type, it is of course possible to apply images to the packaged balloon in ink-jet printers of the "bottom-loading" type, in which case it is preferred that the packaged balloon is loaded into the printer from the rear side, so as to avoid the need for the packaged balloon to adopt a folded path during its passage through the printer. However, the image-applying apparatus may be of any suitable type.

FIG. 5(*a*) illustrates an embodiment of the present invention in which the packaged balloons 14 are supplied in a continuous band. In this case, a line of perforations 19 is formed between the adjacent cover sheets 10 of the respective packaged balloons 14 so as to facilitate separation of the packaged balloons 14, either by a retailer when an individual packaged balloon 14 is sold or by a consumer who has purchased a number of connected packaged balloons 14, prior to insertion of an individual packaged balloon 14 into a printer.

FIG. 5(*b*) illustrates an embodiment of the present invention in which such a continuous band of packaged balloons 14 is supplied as a fan-fold stack. This drawing shows more clearly how the cover sheets 10 are connected together, each cover sheet 10 being attached to a respective folded balloon 1. It can be seen that each folded balloon 1 is attached to the same side of the connected cover sheets 10, for ease of manufacture.

FIG. 5(*c*) illustrates an alternative embodiment of the present invention in which a continuous band of packaged balloons 14 is supplied as a reel 20 on a drum 21. Again, the folded balloons 1 are attached to the same side of the connected cover sheets 10.

FIG. 6(*a*) illustrates a preferred embodiment of the present invention in the form of a greetings card 22 bearing a "Happy Birthday" message 23. In this arrangement, the part of the card 22 bearing the message 23 forms a cover sheet 10 for a folded balloon 1, such that the first surface of the folded balloon 1 faces away from the rear surface of the card 22.

This first surface is protected by an additional transparent sheet 16 of the type used in the embodiment described above with reference to FIG. 3(*c*). An image may be printed on the first surface of the folded balloon 1 by a recipient of the card 22 after removing the protective layer 16 and after detaching the front portion 24 of the card 22 from the remainder of the card 22. Alternatively, an image may already have been printed on this surface by the sender of the card 22, in which case the card 22 would have been inserted into the sender's printer with the fold 25 of the card 22 acting as a leading edge. In this case, the sender would remove the protective transparent layer 16 before printing the image and subsequently reattach the layer 16 prior to sending the card 22.

FIG. 6(*b*) illustrates an alternative embodiment, which is identical to that of FIG. 6(*a*), except that the fold 25 of the greetings card 22 is at the top edge. With this arrangement, it will be appreciated that the card 22 can be inserted into a printer with the top edge as the leading edge.

Although FIGS. 6(*a*) and 6(*b*) illustrate rectangular greetings cards 22 in a portrait orientation, any suitable shape and orientation of greetings card is envisaged by the present invention.

A further embodiment of the present invention is illustrated in FIG. 7, in which a light source 26, in the form of a substantially flat light-emitting diode, is arranged inside the balloon 1 and electrically connected to a source of power (not shown), located either inside or outside the balloon, by means of a thin wire conductor 27. Such an arrangement is particularly beneficial when the material of the balloon 1 is highly translucent, which is achieved by manufacturing the balloon 1 at least partially without the standard metallic foil component. In this case, the light source 26 acts a source of back-illumination for any design which has been applied to the surface of the balloon 1. The light source 26 is suspended within the balloon 1, either away from or adjacent, the inner surface thereof by means of the wire conductor 27.

An alternative embodiment is illustrated in FIG. 8, in which a number of light sources 26, again in the form of substantially flat light-emitting diodes, are attached to the inner surface of the balloon 1 and, as with the arrangement shown in FIG. 7, connected to a source of power by means of a wire conductor 27. In this case, the wire conductor 27 passes through a holding leash or ribbon 28 of the balloon 1 and the source of power comprises a battery 29, the weight of which enables the balloon 1 to remain at a desired height even when filled with a gas which is less dense than air, such as helium.

In each of the above two embodiments, it would be possible to incorporate a coloured filter, either as a component of the light source or as an additional layer within the material of the balloon, which would enhance the aesthetic appearance of the inflated balloon.

In a further alternative embodiment, the light sources of the FIG. 8 embodiment are arranged on the outer surface of the balloon 1, in which arrangement, the balloon 1 is illuminated even if the material of the balloon 1 is opaque.

Although the present invention has been described above with reference to preferred embodiments, it will be apparent to the skilled person that numerous alternative arrangements are possible without departing from the scope of the present invention which is defined solely by the following claims.

The invention claimed is:

1. A packaged balloon on which an image is to be applied, the packaged balloon comprising:

(a) a substrate;

(b) a balloon which is folded around the substrate so as to present a first face on which the image is to be applied, and a second face containing at least one edge of the balloon; and (c) a planar member attached to the second face of the folded balloon so as to cover the at least one edge of the balloon, wherein the planar member extends beyond the area occupied by the folded balloon so as to define a leading edge to facilitate the insertion of the packaged balloon into a printer.

2. A packaged balloon as claimed in claim 1, wherein the balloon comprises foil and at least a part of the first face of the folded balloon has been treated to permit an image to be applied thereto by ink-jet printing.

3. A packaged balloon as claimed in claim 1, wherein the planar member comprises a material selected from: paper, card, polyester and plastic.

4. A packaged balloon as claimed in claim 1, wherein the balloon is releasably attached to the substrate by an adhesive.

5. A packaged balloon as claimed in claim 1, wherein the substrate comprises a material selected from: paper, card, polyester and plastic.

6. A packaged balloon as claimed in claim 1, wherein the planar member is attached to the folded balloon by means of at least one line of adhesive across the width of the leading edge of the packaged balloon.

7. A packaged balloon as claimed in claim 1, wherein the planar member is formed integrally with, or joined to, a further planar member extending across an edge of the first surface of the folded balloon, thereby to provide a single leading edge to facilitate insertion of the packaged balloon into an image-applying apparatus.

8. A packaged balloon as claimed in claim 7, wherein both the planar member and the further planar member extend beyond the area occupied by the folded balloon so as to define a leading edge to facilitate the insertion of the packaged balloon into a printer.

9. A packaged balloon as claimed in claim 1, further comprising a cover which extends over at least part of the planar member and which is folded over one of the edges of the planar member and is attached to an edge of the first surface of the folded balloon, so as to define a leading edge to facilitate the insertion of the packaged balloon into a printer.

10. A packaged balloon as claimed in claim 1, further comprising a protective cover which extends over the first surface of the folded balloon and which can be removed from the folded balloon prior to an image being applied thereto.

11. A packaged balloon as claimed in claim 1, wherein the unfolded balloon is substantially circular.

12. A packaged balloon as claimed in claim 1 and having a size substantially equal to A4.

13. A packaged balloon as claimed in claim 1 and having a size substantially equal to, or substantially larger than, A3.

14. A packaged balloon as claimed in claim 1, wherein at least a part of the balloon comprises translucent foil.

15. A packaged balloon as claimed claim 1, and provided within a vacuum-sealed container.

16. A packaged balloon as claimed in claim 7, wherein the planar member is attached to the folded balloon by means of at least one line of adhesive across the width of the leading edge of the packaged balloon.

17. A packaged balloon as claimed in claim 16, wherein the single line of adhesive is between the further planar member and the folded balloon.

* * * * *